US005279531A

United States Patent [19]

Jen-Huey

[11] Patent Number: 5,279,531

[45] Date of Patent: Jan. 18, 1994

[54] FOOT EXERCISING APPARATUS

[76] Inventor: Chiou Ju Jen-Huey, No. 63, Lane 271, Lien Tsun Rd., Lien Tsun Li, Feng Yuan, Taichung Hsien, Taiwan

[21] Appl. No.: 30,532

[22] Filed: Mar. 12, 1993

[51] Int. Cl.[5] ..... A63B 23/00

[52] U.S. Cl. ..... 482/70; 482/51; 482/54

[58] Field of Search ..... 482/70, 54, 51–4, 62, 92, 115, 118, 908

[56] References Cited

U.S. PATENT DOCUMENTS

| | | | |
|---|---|---|---|
| 4,402,506 | 4/1985 | Hermelin | 482/70 |
| 4,406,451 | 9/1983 | Gaetano | 482/54 |
| 4,618,139 | 10/1986 | Haaheim | 482/71 |
| 4,679,786 | 7/1987 | Rodgers | 482/72 |
| 4,743,015 | 5/1988 | Marshall | 482/70 |
| 4,813,667 | 11/1988 | Watterson | 482/70 |
| 4,826,152 | 5/1989 | Lo | 482/70 |
| 4,900,013 | 2/1990 | Rodgers, Jr. | 482/70 |
| 5,192,257 | 3/1993 | Panasewicz | 482/70 |

FOREIGN PATENT DOCUMENTS

| | | | |
|---|---|---|---|
| 0207538 | 2/1940 | Switzerland | 482/70 |

*Primary Examiner*—Stephen R. Crow
*Assistant Examiner*—Jerome Donnelly
*Attorney, Agent, or Firm*—Bacon & Thomas

[57] ABSTRACT

A foot exercising apparatus includes two foot plates mounted on two slides respectively inserted in two floor tracks, a first linking-up cable connected between the slides and wound through a set of pulleys at the front, a second linking-up cable connected between the slides and wound through a set of pulleys at the back, a drag resistance regulating device controlled by a knob to regulate the drag resistance of the second-linking-up cable. The foot plates are alternatively moved back and forth on the floor tracks with the legs.

1 Claim, 3 Drawing Sheets

FOOT EXERCISING APPARATUS

BACKGROUND OF THE INVENTION

The present invention relates to exercising apparatus, and more specifically the present invention relates to a mobile foot exercising apparatus for training the muscles of the legs by sliding two foot plates on two sliding rails alternatively. The drag resistance can be adjusted according to the player's physical conditions.

A variety of exercising apparatus have been proposed for exercising different parts of the body, and have appeared on the market. Regular exercising apparatus which are specifically designed for exercising the legs are commonly heavy, and occupy much installation space. Therefore, these exercising apparatus are not suitable for personal use.

SUMMARY OF THE INVENTION

Therefore, the main object of the present invention is to provide an exercising apparatus for exercising the legs which is lightweight, and which occupies less installation space. It is another object of the present invention to provide a foot exercising apparatus which can be conveniently adjusted to produce different drag resistance.

According to the preferred embodiment of the present invention, the foot exercising apparatus comprises two foot plates mounted on two slides inserted in two floor tracks, a first linking-up cable connected between the slides and wound through a set of pulleys at the front, a second linking-up cable connected between the slides and wound through a set of pulleys at the back, and a damping wheel controlled by a knob to adjust the drag resistance of the second linking-up cable. Stop blocks are respectively fastened to the slides to limit their moving range. Pin bearings are arranged in the floor tracks to support the slides for permitting the slides to be alternatively reciprocated by the foot plates with the legs. Rollers are fastened to the slides and supported on the floor tracks to smoothen the reciprocating movement of the foot plates.

DETAILED DESCRIPTION OF THE PREFERRED EMBODIMENT

Figure 1:
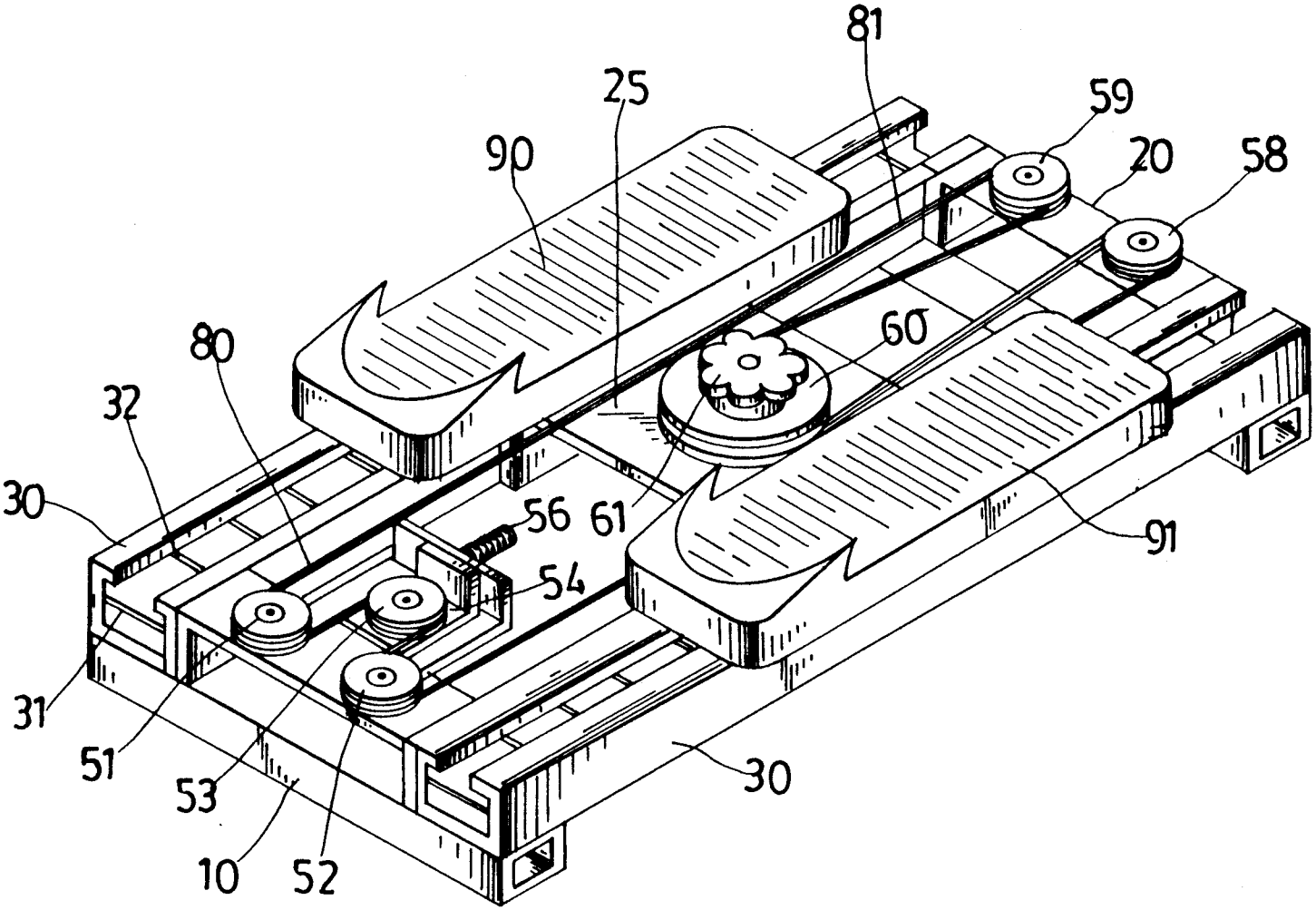
FIG. 1 is an elevational view of a foot exercising apparatus embodying the present invention.
Figure 2:
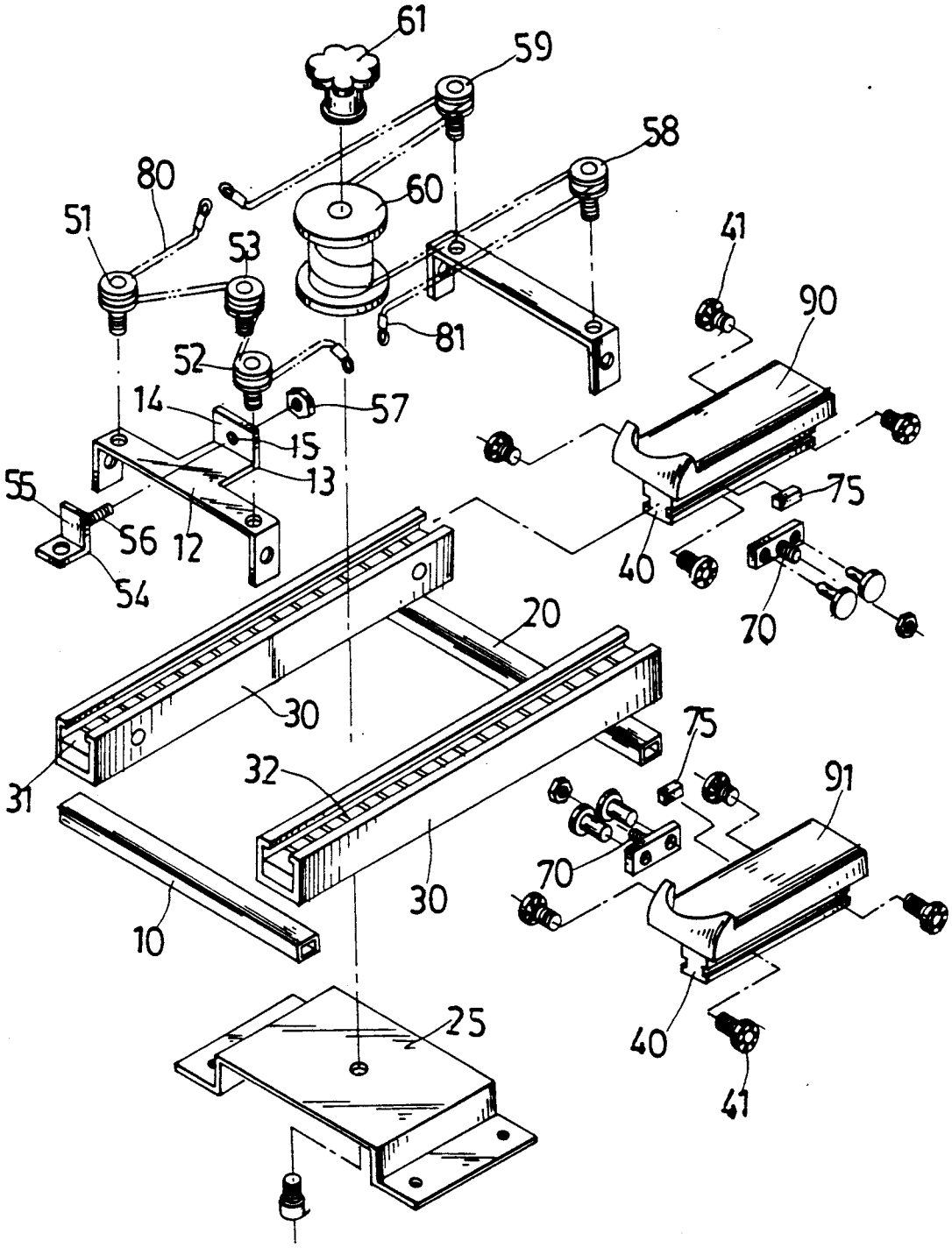
FIG. 2 is an exploded view thereof.

Referring to FIGS. 1 and 2, a foot exercising apparatus in accordance with the present invention is generally comprised of a front stand 10, a rear stand 20, a chassis 25, two floor tracks 30, two slides 40, a pulley assembly, a drag resistance regulating device, two locating members 70, two stop blocks 75, two linking-up cables 80;81, and two foot plates 90;91.

The front stand 10 is made from a hollow, rectangular bar transversely disposed at the front, and fastened with a top frame 12 having a unitary horizontal plate 13 extended backwards in the middle and terminated to a vertical plate 14 with a through hole 15. The rear stand 20 is also made from a hollow, rectangular bar transversely disposed at the back in parallel with the front stand 10. The chassis 25 is transversely disposed in the middle between the front stand 10 and the rear stand 20, having a flat top raised from two opposite lower ends thereof. The two opposite lower ends of the chassis 25 are respectively fastened to the floor tracks 30 at the bottom. The floor tracks 30 are bilaterally connected between the front and rear stands 10;20 at the top, each of which having a T-channel 31 through the respective length respectively fastened with a series of equally spaced pin bearings 32. The slides 40 are respectively fitted into the T-channel 31 on either floor track 30 and moved to slide back and forth on the pin bearings 32 alternatively. Each slide 40 has pairs of rollers 41 supported above the top of the respective floor track 30 to facilitate its reciprocating movement. The pulley assembly is comprised of a first pulley 51 and a second pulley 52 respectively mounted on the top frame 12 on two opposite ends thereof, an adjusting wheel 53 mounted on the horizontal wall 54 of an angle plate 55, which has a screw rod 56 inserted through the through hole 15 on the vertical plate 14 and locked by a nut 57, and a third pulley 58 and a fourth pulley 59 respectively mounted on the rear stand 20 at the top by a frame 16 at locations corresponding to the first and second pulleys 51;52 respectively. The drag resistance regulating device is comprised of a damping wheel 60 and a knob 61. The damping wheel 60 is mounted on the chassis 25 at the top and turned by the knob 61 to regulate the drag resistance of the apparatus. The locating members 70 are respectively fastened to the slides 40 at an inner side. The stop blocks 75 are respectively fastened to the slides 10 below the respective locating member 70. One linking-up cable 80 has one end fastened to the locating member 70 on either slide 40, and an opposite end wound through the first pulley 51, the adjusting wheel. 53, and the second pulley 52 in proper order, and then fastened to the locating member 70 on the other slide 40. The other linking-up cable 81 has front end fastened to the locating member 70 on either slide 40, and an opposite end wound through the third pulley 58 and the damping wheel 60, then wound through the fourth pulley 59, and then connected to the locating member 70 on the other slide 40. The foot plates 90;91 are respective fastened to the slides 40 at the top. When assembled, as shown in FIG. 1, the apparatus is used for sliding the foot plates 90;91 with the legs on the tracks 30.

Figure 3:
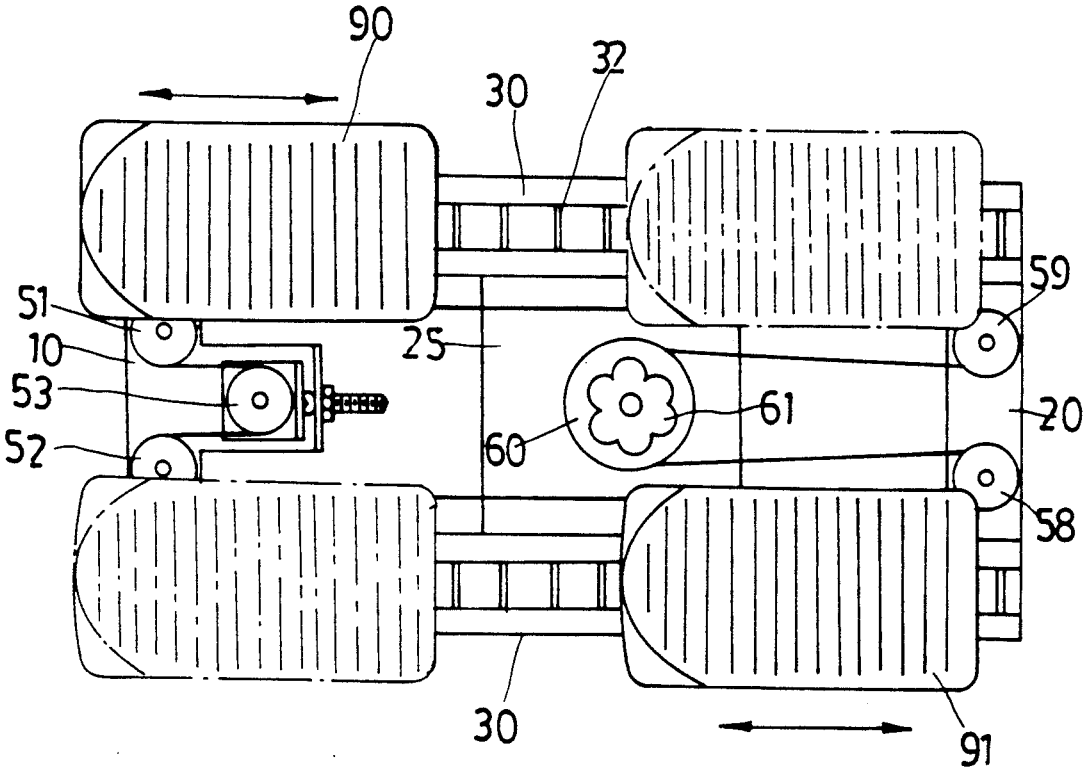
FIG. 3 is a plan view showing the foot plates alternatively reciprocated.

The operation of the present invention is outlined hereinafter with reference to FIG. 3. The player stands on the foot plates 90;91, then moves the foot plates 90;91 with the legs back and forth on the tracks 30 alternatively. As the foot plates 90;91 are alternatively moved, the slides 40 are respectively moved to stretch the linking-up cables 80;81. During the reciprocating motion of the foot plates 90;91, the stop blocks 75 are alternatively stopped by the front and rear stands 10;20, and therefore the slides 40 are prohibited from disconnecting from the tracks 30. The drag resistance from the linking-up cables 80;81 can be adjusted by turning the damping wheel 60 through the knob 61. Because the slides 40 are respectively supported on the needle bearings 32 and guided by the respective rollers 41, the foot plates 90;91 can be smoothly and stably moved on the tracks 30.

I claim:

1. A foot exercising apparatus comprising:

a front stand made from a hollow, rectangular bar transversely disposed at the front, and fastened with a top frame having a unitary horizontal plate extended backwards in the middle and terminated to a vertical plate;

a rear stand made from a hollow, rectangular bar transversely disposed at the back in parallel with said front stand;

two floor tracks bilaterally connected between said front and rear stands at the top, each floor track having an inverted T-channel through the respective length respectively fastened with a series of equally spaced pin bearings;

two slides respectively fitted into the T-channel on either floor track and moved to slide back and forth on said pin bearings alternatively, each slide having a pair of rollers supported above the top of the respective floor track;

a chassis transversely disposed in the middle between said front and rear stands, having a flat top raised from two opposite lower ends thereof, the two opposite lower ends of said chassis being respectively fastened to said floor tracks at the bottom;

a pulley assembly consisted of a first pulley and a second pulley respectively mounted on said top frame on two opposite ends thereof, an adjusting wheel mounted on an angle plate fastened to the vertical plate of said top frame, and a third pulley and a fourth pulley respectively mounted on said rear stand at the top by a frame at locations corresponding to said first and second pulley respectively;

a drag resistance regulating device comprised of a damping wheel mounted on the flat top of said chassis at the top and controlled by a knob;

two locating members respectively fastened to said slides at an inner side;

two stop blocks respectively fastened to said slides below said respective locating member to limit the moving distance of said slides on said tracks within said front and rear stands;

a first linking-up cable having one end fastened to the locating member on either slide, and an opposite end wound through said first pulley, said adjusting wheel and said second pulley in proper order, and then fastened to the locating member on the other slide;

a second linking-up cable having one end fastened to the locating member on either slide, and an opposite end wound through said third pulley and said damping wheel, then wound through said fourth pulley, and then connected to the locating member on the other slide; and two foot plates respective mounted on said slides at the top.

* * * * *